US005600111A

United States Patent [19]

Dufournet

[11] Patent Number: 5,600,111

[45] Date of Patent: Feb. 4, 1997

[54] CIRCUIT-BREAKER HAVING LOW SELF-COMPRESSION

[75] Inventor: Denis Dufournet, Bron, France

[73] Assignee: Gec Alsthom T & D SA, Paris, France

[21] Appl. No.: 441,459

[22] Filed: May 15, 1995

[30] Foreign Application Priority Data

May 19, 1994 [FR] France ..... 94 06128

[51] Int. Cl.[6] ..... H01H 33/915

[52] U.S. Cl. ..... 218/61; 218/59

[58] Field of Search ..... 200/43, 57–67

[56] References Cited

U.S. PATENT DOCUMENTS

| | | | |
|---|---|---|---|
| 4,650,941 | 3/1987 | Thuries et al. | 218/59 |
| 4,650,942 | 3/1987 | Perret | 218/59 |
| 4,983,791 | 1/1991 | Thuries et al. | 218/59 |
| 4,996,399 | 2/1991 | Thuries et al. | 218/65 |
| 5,079,392 | 1/1992 | Tsukushi et al. | 218/59 |
| 5,105,058 | 4/1992 | Perret | 218/65 |
| 5,160,818 | 11/1992 | Dufournet et al. | 218/66 |

FOREIGN PATENT DOCUMENTS

| | | | |
|---|---|---|---|
| 0591039A1 | 4/1994 | European Pat. Off. | H01H 33/91 |
| 4025553A1 | 2/1992 | Germany | H01H 33/915 |
| 2-220319 | 9/1990 | Japan | 218/61 |

*Primary Examiner*—J. R. Scott

*Attorney, Agent, or Firm*—Sughrue, Mion, Zinn, Macpeak & Seas

[57] ABSTRACT

A circuit-breaker including two arcing contacts that co-operate with each other, at least one of which is part of a moving contact assembly that is secured to a drive member and that is constituted by a first tube carrying the moving arcing contact at its end, and by a second tube that is coaxial with the first tube so as to define firstly an expansion chamber on one side of an annular wall, and secondly a compression chamber on the other side of the annular wall, the compression chamber being closed by a piston. A compression device is provided for compressing the gas in the compression chamber during a first portion of the displacement of the moving contact assembly, and a pressure-reducing device is provided for reducing the pressure of the gas in the compression chamber during a second portion of the same displacement of the moving contact assembly. The compression device comprises the fixed piston that co-operates with the first tube over a certain travel distance x, and the pressure-reducing device includes a device for exhausting the gas contained in the compression chamber from the compression chamber, and which operates once the distance x has been travelled.

10 Claims, 4 Drawing Sheets

CIRCUIT-BREAKER HAVING LOW SELF-COMPRESSION

FIELD OF THE INVENTION

The present invention relates to a circuit-breaker having booster self-compression, in particular for high voltages.

More precisely, it concerns a puffer-type circuit-breaker comprising an insulating casing filled with a dielectric gas under pressure, two arcing contacts that co-operate with each other, at least one of which is part of a moving contact assembly that is secured to a drive member and that is suitable for being displaced axially inside the casing between a closed position and an open position, the moving contact assembly being constituted by a first tube carrying the moving arcing contact at its end, and by a second tube that is coaxial with the first tube so as to define firstly an expansion chamber of constant volume and closed by a blast nozzle on one side of an annular wall interconnecting the first tube and the second tube, and secondly a compression chamber on the other side of said annular wall, the compression chamber being closed by a piston, and communicating with the expansion chamber, compression first means being provided for compressing the gas in the compression chamber during a first portion of the displacement of the moving contact assembly between the closed position and the open position, and pressure-reducing second means being provided for reducing the pressure of the gas in the compression chamber during a second portion of the same displacement of the moving contact assembly.

BACKGROUND OF THE INVENTION

Such a circuit-breaker is described in Patent Application EP-0 591 039 filed by the Applicant.

In that prior art document, the piston is semi-moving, and it is provided with means for holding the piston stationary during a first portion of the displacement of the moving contact assembly between the closed position and the open position, and means for displacing the piston axially with the moving contact assembly during a second portion of the same displacement of the moving contact assembly. The means for displacing the piston axially are constituted by a drive member secured to the moving contact assembly, which drive member drives an abutment secured to the piston during the second portion of the displacement of the moving contact assembly, the abutment being disposed in the path of the drive member. The piston is connected to a third tube provided with at least one slot in which a finger is slidably mounted, the finger being secured to the first tube and extending radially therefrom towards the second tube. The means for holding the piston stationary are constituted by a spring disposed between the drive member and the piston, and by a fixed retaining member that co-operates with the piston.

When low currents are to be interrupted, the arc that is produced between the arcing contacts during an opening step is extinguished by means of compressing the gas in the compression chamber. But the arc is blasted by a flow of gas from the compression chamber before the end of the displacement of the moving contact assembly. Therefore, it is not necessary to compress the gas in the compression chamber during the entire displacement of the moving contact assembly. Once the piston starts being displaced with the moving contact assembly, the quantity of energy required to drive the moving contact assembly is very small because the gas is no longer compressed.

Unfortunately, in that known configuration, the spring urging the semi-moving piston continuously applies a force to the control rod, thereby giving rise to an increase in the drive energy required.

OBJECTS AND SUMMARY OF THE INVENTION

An object of the invention is to provide a circuit-breaker that uses a small amount of drive energy and that is therefore cheap, which circuit-breaker blasts low currents by self-compression and blasts high currents by thermal expansion.

To this end, the invention provides that the compression means comprises the fixed piston that co-operates with the first tube over a certain travel distance x, and the pressure-reducing means comprises means for exhausting the gas contained in the compression chamber from said compression chamber, and which operates act once distance x has been travelled.

Advantageously, the travel distance x is equal to the distance travelled by the moving arcing contact over the fixed arcing contact before they separate.

In a preferred embodiment, the first tube is closed by an end wall disposed at a certain distance d1 from the annular wall and on that side thereof which is opposite from the arcing contacts.

Preferably, the pressure-reducing means comprises at least one slot provided in the first tube, which slot is disposed on that side of the annular wall which is opposite from the arcing contacts, and its length is greater than the thickness of the piston, that edge of the slot which is further from the annular wall being at a distance d from the annular wall, distance d being not more than distance d1, and, when the circuit-breaker is in the closed position, that face of the piston which is opposite from the moving arcing contact (7A) being situated at a distance equal to d+x from the annular wall.

Furthermore, when the circuit-breaker is in the closed position, that edge of the slot which is closer to the annular wall is situated at a distance d2 from the piston that is not less than the total distance travelled by the moving arcing contact.

In which case, advantageously, the slot is adjacent to said end wall, distance d being equal to distance d1.

Optionally, a slidably-mounted annular abutment may be disposed inside the compression chamber, and, after distance x has been travelled, the annular abutment abuts against the annular wall by means of a damping spring disposed between the abutment and the piston.

Optionally, the slot may be made up of a set of orifices provided in the first tube.

Preferably, the gas contained in the compression chamber is exhausted therefrom to the inside of the casing, once distance x has been travelled, and for that purpose, advantageously, the piston is carried by a fixed tube that is coaxial with said first and second tubes, and that is provided with at least one gas exhaust orifice situated in the vicinity of that one of its ends which is further from said contacts.

BRIEF DESCRIPTION OF THE DRAWINGS

A preferred embodiment of the invention is described below in more detail with reference to the accompanying drawings, in which.

DETAILED DESCRIPTION OF THE INVENTION

Figure 1:
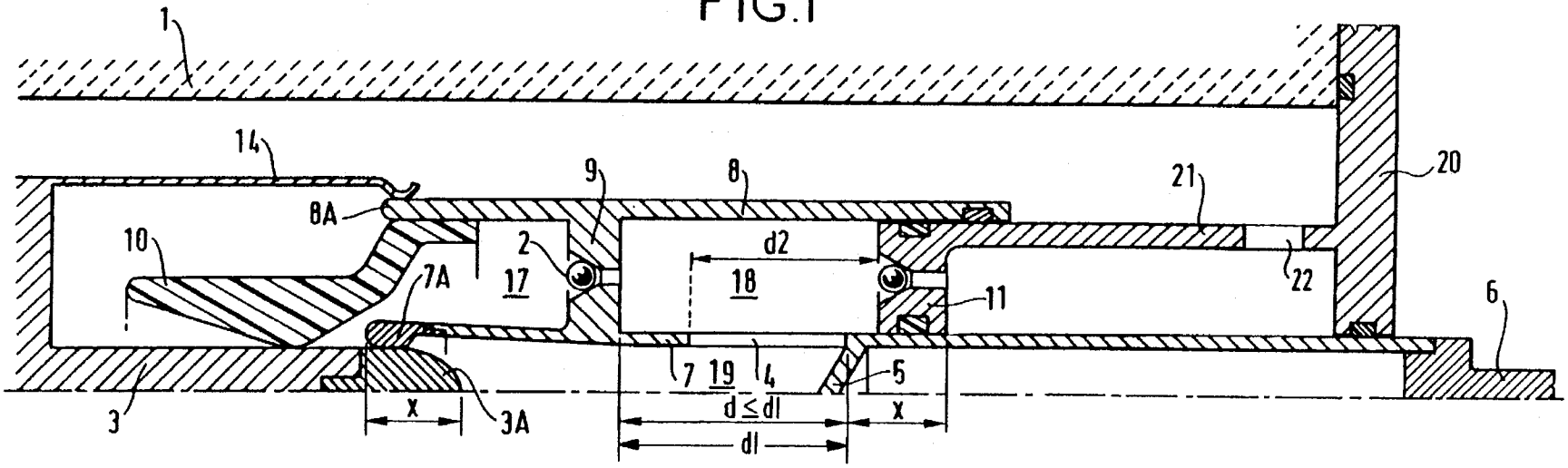
FIG. 1 is a longitudinal section view through a circuit-breaker of the invention in the closed position.

The circuit-breaker shown in the figures comprises, in conventional manner, an insulating casing 1 filled with a dielectric gas under pressure, two arcing contacts 3A and 7A that co-operate with each other, at least one of which is part of a moving contact assembly that is secured to a drive member 6 and that is suitable for being displaced axially inside the casing 1 between a closed position and an open position, the moving contact assembly being constituted by a first tube 7 carrying the moving arcing contact 7A at its end, and by a second tube 8 that is coaxial with the first tube 7 so as to define firstly an expansion chamber 17 of constant volume and closed by a blast nozzle 10 on one side of an annular wall 9 interconnecting the first tube and the second tube, and secondly a compression chamber 18 on the other side of said annular wall, the compression chamber being closed by a piston 11, and communicating with the expansion chamber via a non-return valve 2. The circuit-breaker may also be provided with a permanent contact 14 that co-operates with the end 8A of the second tube 8, which forms a moving permanent contact.

As in the prior art, compression means is provided for compressing the gas in the compression chamber 18 during a first portion of the displacement of the moving contact between the closed position and the open position, and pressure-reducing means is provided for reducing the pressure of the gas in the compression chamber 18 during a second portion of the same displacement of the moving contact assembly.

The compression comprises the fixed piston 11 that co-operates with the first tube 7 over a certain travel distance x during the displacement of the moving assembly, and the pressure-reducing means comprises means for exhausting the gas contained in the compression chamber 18 from said compression chamber, and which operates once distance x has been travelled.

Travel distance x is equal to the distance travelled by the moving arcing contact 7A over the fixed arcing contact 3A before they separate. The first tube 7 is closed by an end wall 5 which is disposed at a certain distance d1 from the annular wall 9 and on that side thereof which is opposite from the arcing contacts.

The second means comprise at least one slot 4 provided in the first tube 7. The slot 4 is disposed on that side of the annular wall 9 which is opposite from the arcing contacts, and its length is greater than the thickness of the piston 11. That edge of the slot 4 which is further from the annular wall 9 is at a distance d from said annular wall 9, distance d being equal to, or optionally less than, distance d1. When the circuit-breaker is in the closed position, that face of the piston 11 which is opposite from moving arcing contact 7A is situated at a distance equal to d+x from the annular wall 9. Furthermore, when the circuit-breaker is in the closed position, that edge of the slot 4 which is closer to the annular wall 9 is situated at a distance d2 from the piston 11 that is not less than the total distance travelled by the moving arcing contact 7A.

The slot 4 may be made up of a set of orifices provided in the first tube 7. The orifices may be lined up along a generator line of the tube 7 and/or disposed on different generator lines. In which case, the above-mentioned edges are the end edges of the set of orifices.

The piston 11 is carried by a fixed tube 21, e.g. that is secured to the terminal plate 20, that is coaxial with said first and second tubes 7 and 8, and that is provided with at least one gas exhaust orifice 22 situated in the vicinity of that one of its ends which is further from said contacts 3A and 7A.

Figure 2:
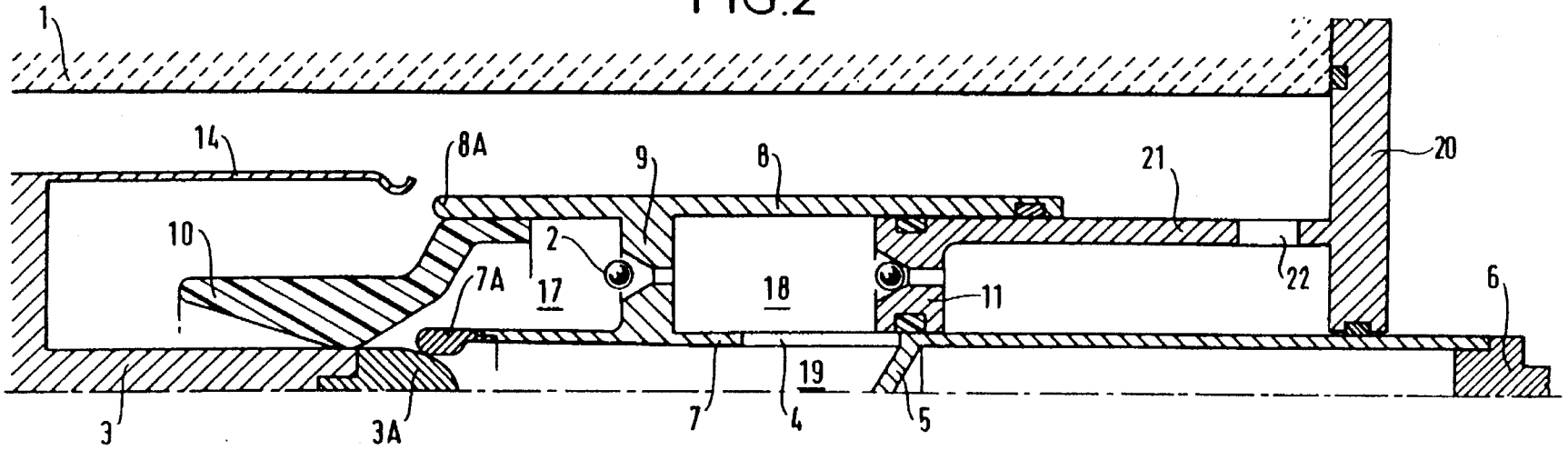
FIGS. 2 and 3 are longitudinal section views through a circuit-breaker of the invention in intermediate positions between the closed position and the open position.

During circuit-breaker opening, the moving contact assembly driven by the drive member 6 is displaced towards the right (as shown in FIG. 1), and the fixed piston 11 and the tube 7 are displaced relative to each other over a travel distance x as shown in FIG. 2. The gas is then compressed in the compression chamber 18 and it pushes the valve member 2 to the open position. The gas is therefore also compressed in the expansion chamber 17. Because of the slot 4, the gas is also compressed in the volume 19 inside the first tube 7, volume 19 then being closed by the wall 5 and by the fixed contact 3A co-operating with the moving contact 7A.

Figure 3:
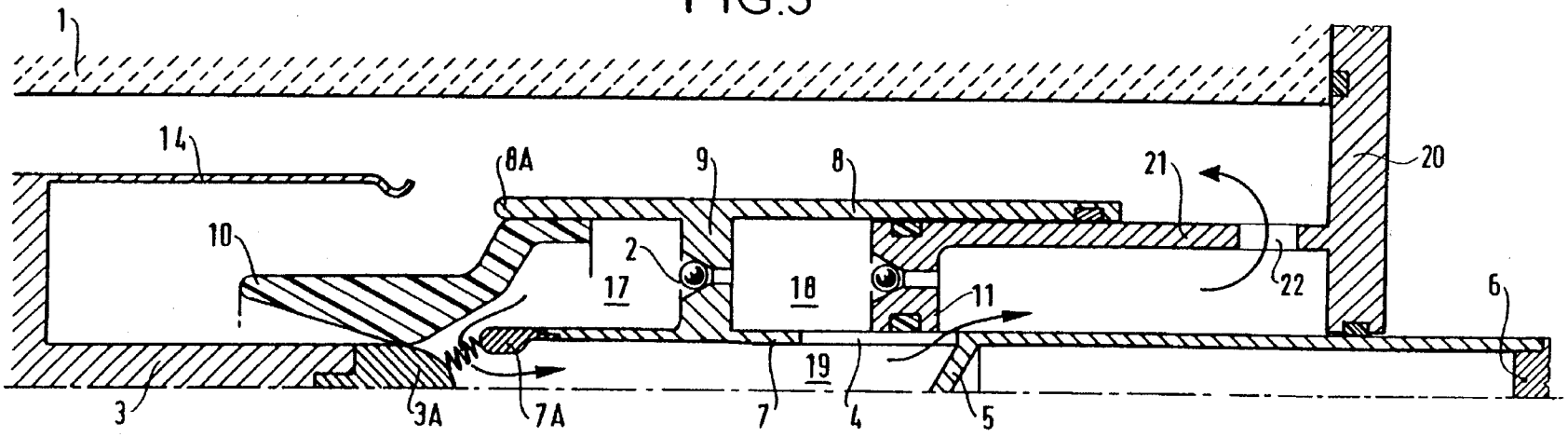

Once the moving contact assembly has travelled distance x, it continues to move and it reaches the position shown in FIG. 3. The piston 11 then lies over the slot 4, and the contacts 3A and 7A separate. An arc therefore forms between the contacts. Effective compression is then finished. The compression chamber 18 and the inside volume 19 of the first tube 7 are open and the compressed gas can escape towards the rear of the piston 11 and can be exhausted via the orifice(s) 22 to the inside of the casing. The valve 2 closes. The expansion chamber 17 is also open and the compressed gas therein blasts the arc between the contacts 3A and 7A. The extra pressure generated over the travel distance x is then sufficient to interrupt low currents corresponding to a range of 15% to 20% of the interrupting capability. Moreover, in the presence of high currents, in view of the heat given off by the arc, the pressure increases in chamber 17 by thermal expansion. By choosing optimum dimensions for the expansion chamber 17, it is possible to interrupt high currents by thermal expansion only. It should be noted that such expansion has no reaction on the drive rod 6.

Figure 4:
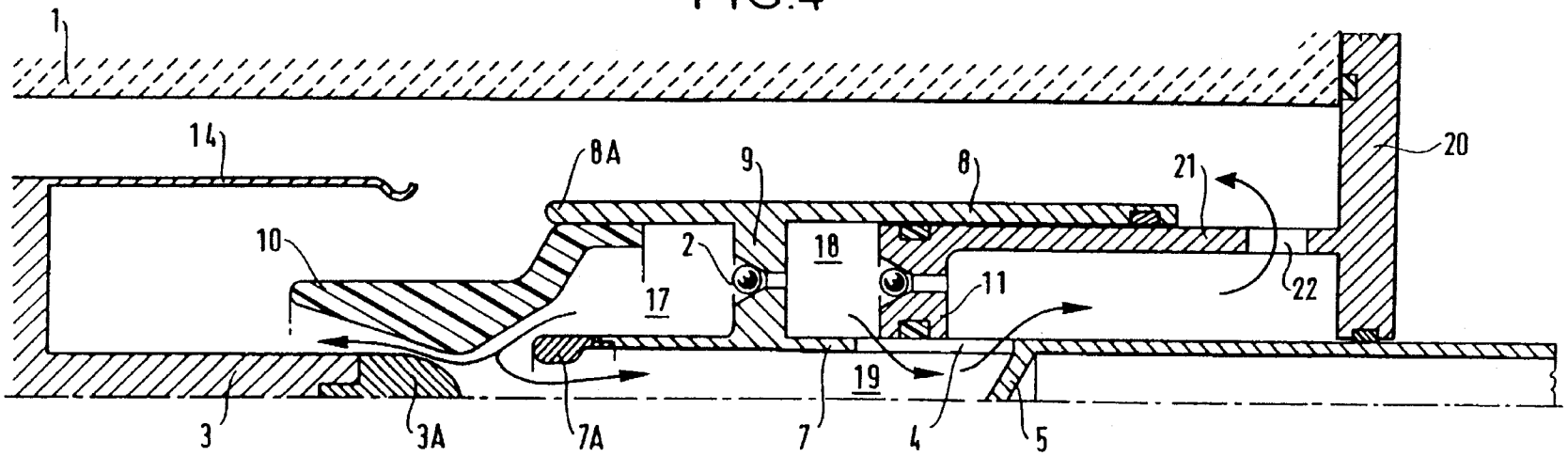
FIG. 4 is a longitudinal section view through a circuit-breaker of the invention in the open position.

The moving assembly continues to be displaced until it reaches the open position shown in FIG. 4, and the blast continues between the contacts 3A and 7A while the Gas continues to be exhausted to the rear of the piston 11. Since distance d2 is not less than the total distance travelled by the moving arcing contact, at the end of opening, the compression chamber 18 still communicates with the volume 19 and the gas in chamber 18 can still be exhausted.

Figure 5:
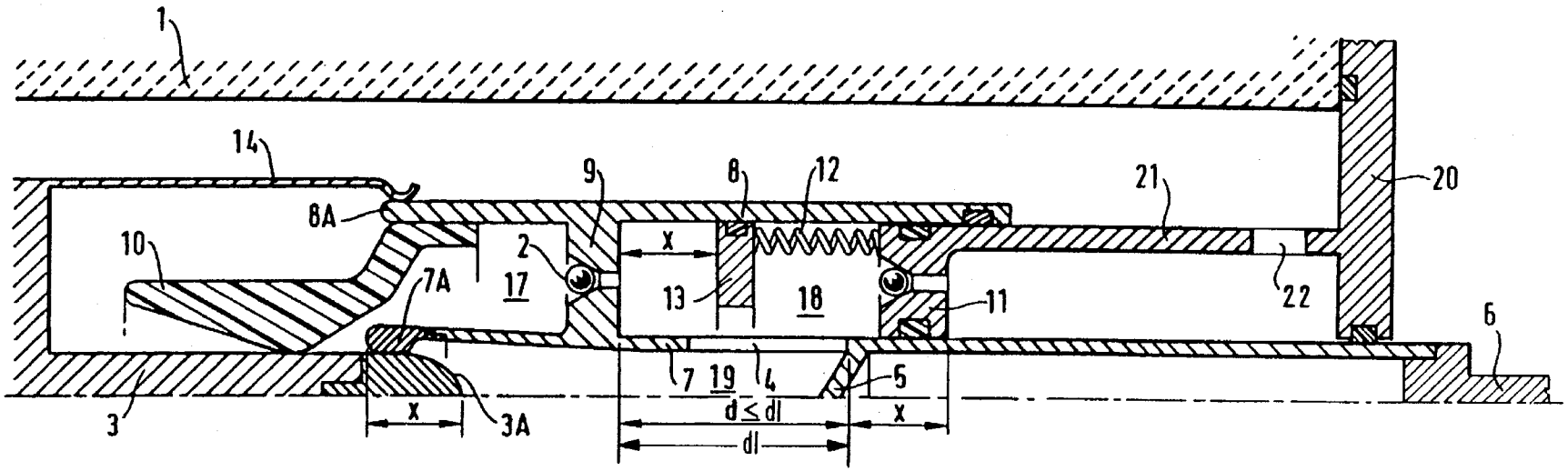
FIGS. 5 to 7 are longitudinal section views through a circuit-breaker of a variant embodiment of the invention respectively in the closed position, an intermediate position, and the open position.
Figure 6:
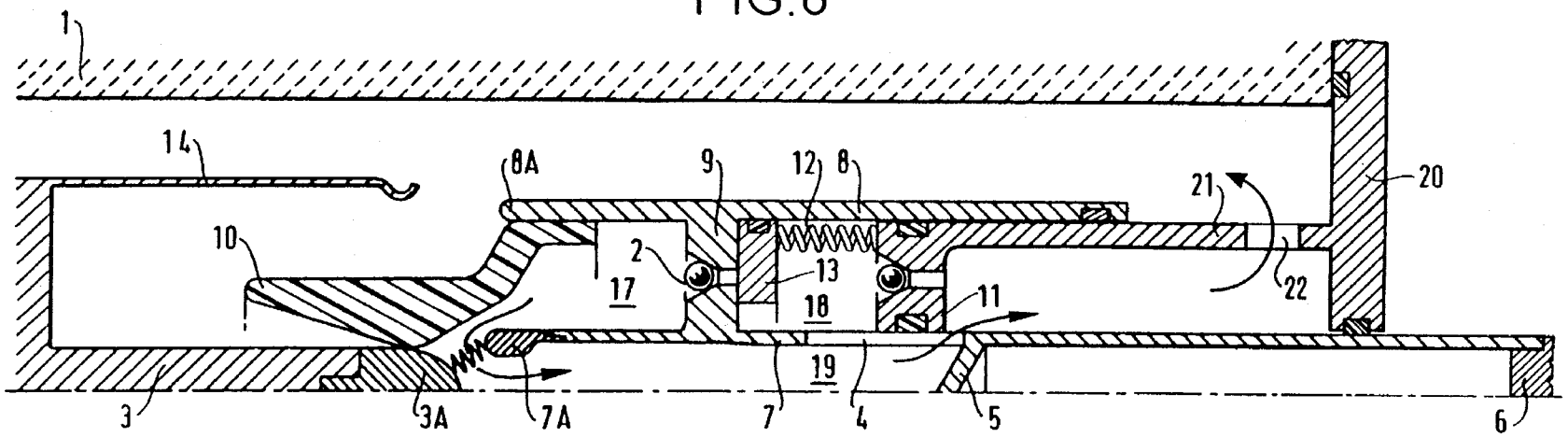
Figure 7:
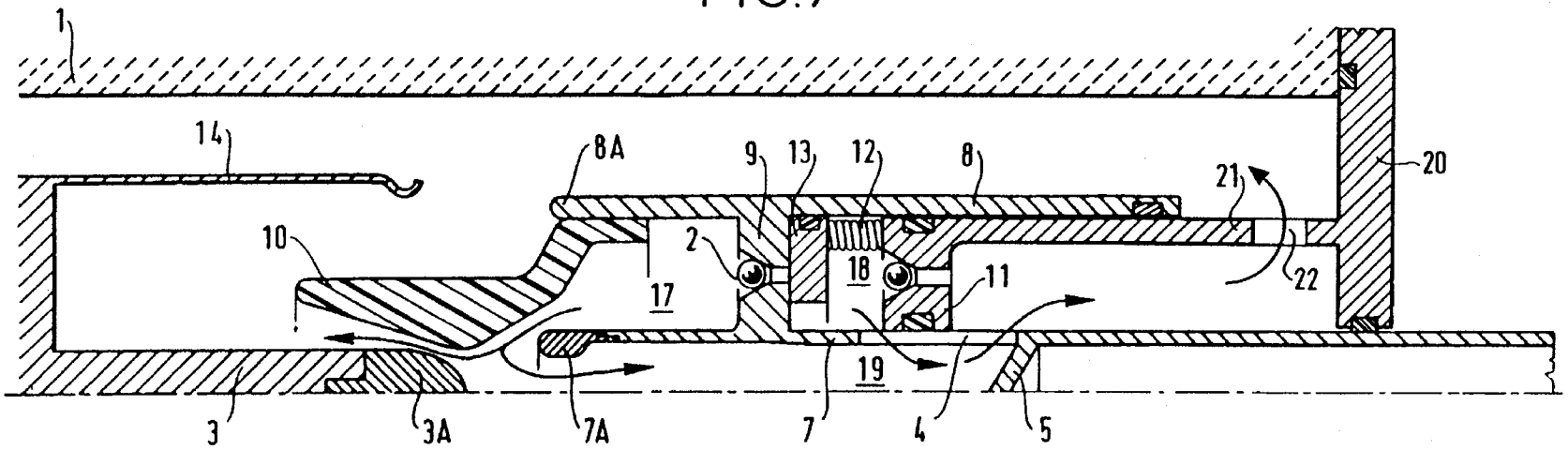

In a variant embodiment shown in FIGS. 5 to 7, a slidably-mounted annular abutment 13 is disposed inside the compression chamber 18. After distance x has been travelled, the annular abutment 13 abuts against the annular wall 9 by means of a damping spring 12 disposed between the abutment 13 and the piston 11, and fixed via its ends therebetween.

The circuit-breaker in this variant embodiment operates as above except that, as shown in FIG. 6, once distance x has been travelled, the abutment 13 abuts against the annular wall 9, and during the remainder of the displacement, the spring 12 acts as a damper by being compressed until the end of the displacement, as shown in FIG. 7. It should be noted that energy from the spring 12 contributes to re-closing the circuit-breaker.

I claim:

1. A puffer-type circuit-breaker comprising:

an insulating casing filled with a dielectric gas under pressure; a fixed piston mounted on the casing and extending within the casing; a fixed arcing contact and a moving arcing contact that co-operate with each other; a moving contact assembly, including the moving arcing contact, that is secured to a drive member and that is operative for displacement axially inside the casing between a closed position and an open position, the moving contact assembly including a first tube having one end which carries the moving arcing contact thereon, a second tube that is coaxial with the first tube, the second tube having an end with a blast nozzle mounted thereon, and an annular wall interconnecting the first tube and the second tube, so as to define an expansion chamber of constant volume between the first and second tubes, the blast nozzle and one side of the annular wall, and a compression chamber located on the other side of the annular wall, the compression chamber being defined between the first and second tubes, the fixed piston and the other side of the annular wall, and communicating with the expansion chamber; compression means for compressing the gas in the compression chamber during a first portion of the displacement of the moving contact assembly between the closed position and the open position; and pressure-reducing means for reducing the pressure of the gas in the compression chamber during a second portion of the displacement of the moving contact assembly, wherein the compression means comprises the fixed piston that co-operates with the first tube over a certain travel distance x, and the pressure-reducing means comprises means for non-recoverably exhausting the gas contained in the compression chamber from said compression chamber and which operates once the distance x has been travelled.

2. The circuit-breaker according to claim 1, wherein the travel distance x is equal to the distance travelled by the moving arcing contact over the fixed arcing contact before they separate.

3. The circuit-breaker according to claim 1, wherein the first tube is closed by an end wall disposed at a distance d1 from the other side of the annular wall and which is a side opposite from the fixed and moving arcing contacts.

4. The circuit breaker according to claim 3, wherein the pressure-reducing means comprises at least one slot provided in the first tube, said slot being disposed on the other side of the annular wall which is opposite from the fixed and moving arcing contacts, said slot having a length which is greater than a thickness of the fixed piston, an edge of the slot which is further from the annular wall being at a distance d from the annular wall, the distance d being less than or equal to the distance d1, and, when the circuit-breaker is in the closed position, a surface of the fixed piston which faces away from the annular wall being situated at a distance equal to d+x from the annular wall.

5. The circuit-breaker according to claim 4, wherein, when the circuit-breaker is in the closed position, an edge of the slot which is closer to the annular wall is situated at a distance d2 from the fixed piston, the distance d2 not being less than the total distance travelled by the moving arcing contact.

6. The circuit-breaker according to claim 4, wherein the slot is adjacent to said end wall, the distance d being equal to the distance d1.

7. The circuit-breaker according to claim 1, wherein a slidably-mounted annular abutment is disposed inside the compression chamber, and, after the distance x has been travelled, the annular abutment abuts against the annular wall by a damping spring disposed between the abutment and the fixed piston.

8. The circuit-breaker according to claim 4, wherein the slot is made up of a set of orifices provided in the first tube.

9. The circuit-breaker according to claim 1, wherein the gas contained in the compression chamber is exhausted therefrom to the inside of the casing, once the distance x has been travelled.

10. The circuit-breaker according to claim 4, wherein the fixed piston is carried by a fixed tube that is coaxial with said first and second tubes, the fixed tube being provided with at least one gas exhaust orifice situated in the vicinity of an end of the fixed piston which is located further from said fixed and moving arcing contacts.

* * * * *